US006099797A

United States Patent [19]

Bhagwat et al.

[11] Patent Number: 6,099,797

[45] Date of Patent: Aug. 8, 2000

[54] STEEL TIRE CORD WITH HIGH TENSILE STRENGTH

[75] Inventors: Anand Waman Bhagwat, Hudson; Sameer Suresh Vijayakar, Sagamore Hills; Dong Kwang Kim, Akron, all of Ohio

[73] Assignee: The Goodyear Tire & Rubber Company, Akron, Ohio

[21] Appl. No.: 09/239,235

[22] Filed: Jan. 28, 1999

Related U.S. Application Data

[63] Continuation-in-part of application No. 08/908,496, Aug. 7, 1997, abandoned.

[60] Provisional application No. 60/025,432, Sep. 4, 1996.

[51] Int. Cl.[7] ..... C22C 38/18

[52] U.S. Cl. ..... 420/91; 420/100; 420/101; 420/104; 420/105; 420/108

[58] Field of Search ..... 420/90, 91, 96, 420/97, 100, 101, 104, 105, 108

[56] References Cited

U.S. PATENT DOCUMENTS

| | | | |
|---|---|---|---|
| 4,642,219 | 2/1987 | Takata et al. | 420/104 |
| 4,960,473 | 10/1990 | Kim et al. | 148/12 B |
| 5,066,455 | 11/1991 | Kim et al. | 420/100 |
| 5,167,727 | 12/1992 | Kim et al. | 524/407 |
| 5,478,523 | 12/1995 | Brusso et al. | 420/90 |
| 5,705,124 | 1/1998 | Ochi et al. | 420/105 |

FOREIGN PATENT DOCUMENTS

| | | |
|---|---|---|
| 0516857 | 11/1991 | European Pat. Off. . |
| 0693570 | 4/1994 | European Pat. Off. . |

OTHER PUBLICATIONS

Patent Abstracts of Japan, vol. 17, No. 247 (C–1059), May 18, 1993 & JP 04 371549 A (Kobe Steel Ltd), Dec. 24, 1992.

Patent Abstracts of Japan, vol. 15, No. 007 (C–794), Jan. 9, 1991 & JP 02 258953 A (Nippon Steel Corporation), Oct. 19, 1990.

*Primary Examiner*—John Sheehan

*Attorney, Agent, or Firm*—Alvin T Rockhill

[57] ABSTRACT

This invention reveals steel alloys for use in manufacturing reinforcing wires for rubber products, such as tires. The steel filaments made with such steel alloys have an outstanding combination of strength and ductility. The steel alloys of this invention can be manufactured into filaments having a tensile strength in the range of 4000 MPa to 5000 MPa. Additionally, these can be patented in a low-cost process due to their having a very fast rate of isothermal transformation. This allows the steel in the steel wire being patented to transform from a face-centered cubic microstructure to an essentially body-centered cubic microstructure within a very short period. This invention more specifically discloses a steel alloy composition which is particularly suitable for use in manufacturing reinforcing wire for rubber products which consists essentially of (a) iron, (b) about 1.05 to about 1.7 weight percent carbon, (c) about 0.2 to about 0.8 weight percent manganese, (d) about 0.1 to about 0.8 weight percent silicon, (e) about 0.1 to about 0.7 weight percent chromium, (f) 0.0 to about 0.5 weight percent nickel, (g) 0.0 to about 0.3 weight percent copper, (h) 0.0 to about 0.5 weight percent molybdenum and (i) 0.0 to about 0.5 weight percent vanadium; with the proviso that the carbon equivalent of the steel alloy is within the range of 1.15 to 1.8 weight percent. It is highly preferred for the steel alloys of this invention to contain from about 0.02 to about 0.3 weight percent copper.

16 Claims, No Drawings

STEEL TIRE CORD WITH HIGH TENSILE STRENGTH

This is a continuation-in-part application of U.S. patent application Ser. No. 08/908,496, filed on Aug. 7, 1997 (now abandoned), which claims the benefit of U.S. Provisional Patent Application Serial No. 60/025,432, filed on Sep. 4, 1996.

BACKGROUND OF THE INVENTION

It is frequently desirable to reinforce rubber articles (such as, tires, conveyor belts, power transmission belts, timing belts and hoses) by incorporating therein steel reinforcing elements. Pneumatic vehicle tires are often reinforced with cords prepared from brass-coated steel filaments. Such tire cords are frequently composed of high carbon steel or high carbon steel coated with a thin layer of brass. Such a tire cord can be a monofilament, but normally is prepared from several filaments which are stranded together. In most instances, depending upon the type of tire being reinforced, the strands of filaments are further cabled to form the tire cord.

It is important for the steel alloy utilized in filaments for reinforcing elements to exhibit high strength and ductility as well as high fatigue resistance. Unfortunately, many alloys which possess this demanding combination of requisite properties cannot be processed in a practical commercial operation. More specifically, it is extremely impractical to patent many such alloys which otherwise exhibit extremely good physical properties because they have a slow rate of isothermal transformation which requires a long period in the soak zone (transformation zone). In other words, in the patenting process a long time period in the transformation zone is required to change the microstructure of the steel alloy from face-centered cubic to body-centered cubic.

In commercial operations, it is desirable for the transformation from a face-centered cubic microstructure to a body-centered cubic microstructure in the transformation phase of the patenting process to occur as rapidly as possible. The faster the rate of transformation, the less demanding the equipment requirements are at a given throughput. In other words, if more time is required for the transformation to occur, then the length of the transformation zone must be increased to maintain the same level of throughput. It is, of course, also possible to reduce throughputs to accommodate for the low rate of transformation by increasing the residence time in the transformation zone (soak). For these reasons, it is very apparent that it would be desirable to develop a steel alloy having a fast rate of isothermal transformation in patenting which also exhibits high strength, high ductility and high fatigue resistance.

The patenting process is a heat treatment applied to steel rod and wire having a carbon content of 0.25 percent or higher. The typical steel for tire reinforcement usually contains about 0.65 to 0.85 percent carbon, 0.5 to 0.7 percent manganese and 0.15 to 0.5 percent silicon, with the balance of course being iron. The object of patenting is to obtain a structure which combines high tensile strength with high ductility, and thus impart to the wire the ability to withstand a large reduction in area to produce the desired finished sizes possessing a combination of high tensile strength and good toughness.

Patenting is normally conducted as a continuous process and typically consists of first heating the alloy to a temperature within the range of about 850° C. to about 1150° C. to form austenite, and then cooling at a rapid rate to a lower temperature at which transformation occurs which changes the microstructure from face-centered cubic to body-centered cubic and which yields the desired mechanical properties. In many cases, while it is desired to form a single allotrope, a mixture of allotropes having more than one microstructure is, in fact, produced.

U.S. Pat. No. 4,960,473, U.S. Pat. No. 5,066,455, U.S. Pat. No. 5,167,727 and U.S. Pat. No. 5,229,069 relate to steel alloys for use in manufacturing reinforcing wires for rubber products, such as tires, which can be patented in a low-cost process due to their having a very fast rate of isothermal transformation. These patents disclose the realization of tensile strengths of up to 3256 MPa. However, the tire industry is now calling for even higher tensile strength. In fact, tensile strengths in the range of 4000 MPa to 5000 MPa would be desirable. Even greater tensile strengths of over 4500 MPa are deemed to be more desirable.

SUMMARY OF THE INVENTION

The subject invention discloses steel alloys which can be drawn into filaments having a diameter of 0.2 mm which possess a tensile strength which is greater than 4000 MPa, a high level of ductility, and outstanding fatigue resistance. Filaments made with the alloys of this invention preferably have a tensile strength of greater than 4500 MPa and more preferably have a tensile strength of greater than 4700 MPA. These alloys also exhibit a very rapid rate of transformation in patenting procedures and can accordingly be patented by a low-cost process.

The subject patent application more specifically reveals a steel alloy composition which is particularly suitable for use in manufacturing reinforcing wire for rubber products which consists essentially of (a) iron, (b) about 1.05 to about 1.7 weight percent carbon, (c) about 0.2 to about 0.8 weight percent manganese, (d) about 0.1 to about 0.8 weight percent silicon, (e) about 0.1 to about 0.7 weight percent chromium, (f) 0.0 to about 0.5 weight percent nickel, (g) 0.0 to about 0.3 weight percent copper, (h) 0.0 to about 0.5 weight percent molybdenum and (i) 0.0 to about 0.5 weight percent vanadium; with the proviso that the carbon equivalent of the steel alloy is within the range of 1.15 to 1.8 weight percent, wherein the carbon equivalent is determined by the equation:

$$CE = C + \frac{Mn + Si}{6} + \frac{Ni + Cu}{15} + \frac{Cr + Mo + V}{5}$$

wherein CE represents the carbon equivalent, wherein C represents the weight percentage of carbon in the steel alloy, wherein Mn represents the weight percentage of manganese in the steel alloy, wherein Si represents the weight percentage of silicon in the steel alloy, wherein Ni represents the weight percentage of nickel in the steel alloy, wherein Cu represents the weight percentage of copper in the steel alloy, wherein Cr represents the weight percentage of chromium in the steel alloy, wherein Mo represents the weight percentage of molybdenum in the steel alloy and wherein V represents the weight percentage of vanadium in the steel alloy.

The subject patent application also discloses a process for manufacturing steel filament which has an outstanding combination of strength and ductility which comprises the sequential steps of (1) heating a steel wire in a first patenting step to a temperature which is within the range of about 900° C. to about 1100° C. for a period of at least about 5 seconds, wherein said steel wire is comprised of a steel alloy which consists essentially of (a) iron, (b) about 1.05 to about 1.7 weight percent carbon, (c) about 0.2 to about 0.8 weight percent manganese, (d) about 0.1 to about 0.8 weight percent silicon, (e) about 0.1 to about 0.7 weight percent chromium, (f) 0.0 to about 0.5 weight percent nickel, (g) 0.0 to about 0.3 weight percent copper, (h) 0.0 to about 0.5 weight percent molybdenum and (i) 0.0 to about 0.5 weight percent vanadium; with the proviso that the carbon equivalent of the steel alloy is within the range of 1.15 to 1.8 weight percent, wherein the carbon equivalent is determined by the equation:

$$CE = C + \frac{Mn + Si}{6} + \frac{Ni + Cu}{15} + \frac{Cr + Mo + V}{5}$$

wherein CE represents the carbon equivalent, wherein C represents the weight percentage of carbon in the steel alloy, wherein Mn represents the weight percentage of manganese in the steel alloy, wherein Si represents the weight percentage of silicon in the steel alloy, wherein Ni represents the weight percentage of nickel in the steel alloy, wherein Cu represents the weight percentage of copper in the steel alloy, wherein Cr represents the weight percentage of chromium in the steel alloy, wherein Mo represents the weight percentage of molybdenum in the steel alloy and wherein V represents the weight percentage of vanadium in the steel alloy; (2) rapidly cooling said steel wire to a temperature which is within the range of about 520° C. to about 620° C. within a period of less than about 4 seconds; (3) maintaining said steel wire at a temperature within the range of about 520° C. to about 620° C. for a period which is sufficient for the microstructure of the steel in the steel wire to transform to an essentially body centered cubic microstructure; (4) cold drawing the steel wire to a draw ratio which is sufficient to reduce the diameter of the steel wire by about 40 to about 90 percent; (5) heating the steel wire in a second patenting step to a temperature which is within the range of about 900° C. to about 1150° C. for a period of at least about 1 second; (6) rapidly cooling said steel wire to a temperature which is within the range of about 520° C. to about 620° C. within a period of less than about 4 seconds; (7) maintaining said steel wire at a temperature within the range of about 520° C. to about 620° C. for a period which is sufficient for the microstructure of the steel in the steel wire to transform to an essentially body-centered cubic microstructure; and (8) cold drawing the steel wire to a draw ratio which is sufficient to reduce the diameter of the steel wire by about 80 to about 99 percent to produce said steel filament.

DETAILED DESCRIPTION OF THE INVENTION

The steel alloy compositions of this invention exhibit high tensile strength of greater than 4000 MPa, high ductility and high fatigue resistance. Additionally, they exhibit an extremely fast rate of isothermal transformation behavior. For instance, the alloys of this invention can be virtually completely transformed from a face-centered cubic microstructure to a body-centered cubic microstructure in a patenting procedure within about 20 seconds. In most cases, the alloys of this invention can be essentially fully transformed to a body-centered cubic microstructure within less than about 10 seconds in the patenting process. This is very important since it is impractical in commercial processing operations to allow more than about 15 seconds for the transformation to occur. It is highly desirable for the transformation to be completed with about 10 or less. Alloys which require more than about 20 seconds for the transformation to occur are highly impractical.

The steel alloy of this invention consists essentially of (a) iron, (b) about 1.05 to about 1.7 weight percent carbon, (c) about 0.2 to about 0.8 weight percent manganese, (d) about 0.1 to about 0.8 weight percent silicon, (e) about 0.1 to about 0.7 weight percent chromium, (f) 0.0 to about 0.5 weight percent nickel, (g) 0.0 to about 0.3 weight percent copper, (h) 0.0 to about 0.5 weight percent molybdenum and (i) 0.0 to about 0.5 weight percent vanadium; with the proviso that the carbon equivalent of the steel alloy is within the range of 1.15 to 1.8 weight percent, wherein the carbon equivalent is determined by the equation:

$$CE = C + \frac{Mn + Si}{6} + \frac{Ni + Cu}{15} + \frac{Cr + Mo + V}{5}$$

wherein CE represents the carbon equivalent, wherein C represents the weight percentage of carbon in the steel alloy, wherein Mn represents the weight percentage of manganese in the steel alloy, wherein Si represents the weight percentage of silicon in the steel alloy, wherein Ni represents the weight percentage of nickel in the steel alloy, wherein Cu represents the weight percentage of copper in the steel alloy, wherein Cr represents the weight percentage of chromium in the steel alloy, wherein Mo represents the weight percentage of molybdenum in the steel alloy and wherein V represents the weight percentage of vanadium in the steel alloy. This steel alloy preferably has a carbon equivalent percentage which is within the range of about 1.2 to about 1.6 percent, and most preferably has a carbon equivalent percentage which is within the range of about 1.3 to about 1.5 percent.

This alloy preferably consists essentially of (a) iron, (b) about 1.1 to about 1.5 weight percent carbon, (c) about 0.3 to about 0.7 weight percent manganese, (d) about 0.1 to about 0.6 weight percent silicon, (e) about 0.1 to about 0.6 weight percent chromium, (f) 0.0 to about 0.5 weight percent nickel, (g) 0.0 to about 0.3 weight percent copper, (h) 0.0 to about 0.5 weight percent molybdenum and (i) 0.0 to about 0.5 weight percent vanadium. The steel alloy of this invention more preferably consists essentially of (a) iron, (b) about 1.2 to about 1.4 weight percent carbon, (c) about 0.4 to about 0.6 weight percent manganese, (d) about 0.2 to about 0.4 weight percent silicon, (e) about 0.2 to about 0.5 weight percent chromium, (f) 0.0 to about 0.5 weight percent nickel, (g) 0.0 to about 0.3 weight percent copper, (h) 0.0 to about 0.5 weight percent molybdenum and (i) 0.0 to about 0.5 weight percent vanadium.

It is most preferred to include a small amount of copper in the steel alloys of this invention to increase the ductility and corrosion resistance of the final product. However, the level of copper utilized will normally be less than about 0.3 weight percent because its presence slows the rate of transformation. Thus, copper will generally be employed at a level which is within the range of about 0.02 to about 0.3 weight percent. It is preferred for copper to be present in the steel alloy in an amount which is within the range of about 0.05 to about 0.2 weight percent. It is most preferred for copper to be present in the steel alloy in an amount which is within the range of about 0.10 to about 0.15 weight percent.

A highly preferred steel alloy consists of (a) about 97.59 to about 97.79 weight percent iron, (b) about 1.16 to about 1.20 weight percent carbon, (c) about 0.48 to about 0.52 weight percent manganese, (d) about 0.18 to about 0.22 weight percent silicon, (e) about 0.28 to about 0.32 weight percent chromium and (f) 0.11 to about 0.15 weight percent copper. Another highly preferred steel alloy consists of (a) about 97.41 to about 97.60 weight percent iron, (b) about 1.23 to about 1.26 weight percent carbon, (c) about 0.38 to about 0.42 weight percent manganese, (d) about 0.18 to about 0.22 weight percent silicon, (e) about 0.48 to about 0.52 weight percent chromium and (f) 0.13 to about 0.17 weight percent copper.

Rods having a diameter of about 5 mm to about 6 mm which are comprised of the steel alloys of this invention can be manufactured into steel filaments which can be used in reinforcing elements for rubber products. Such steel rods are typically cold-drawn to a diameter which is within the range of about 2.8 mm to about 3.5 mm. For instance, a rod having a diameter of about 5.5 mm can be cold-drawn to a wire having a diameter of about 3.2 mm. This cold drawing procedure increases the strength and hardness of the metal.

The cold-drawn wire is then patented by heating the wire to a temperature which is within the range of 900° C. to about 1100° C. for a period of at least about 5 seconds. In cases where electrical resistance heating is used, a heating period of about 2 to about 15 seconds is typical. It is more typical for the heating period to be within the range of about 5 to about 10 seconds when electrical resistance heating is used. It is, of course, also possible to heat the wire in a fluidized bed oven. In such cases, the wire is heated in a fluidized bed of sand having a small grain size. In fluidized bed heating techniques, the heating period will generally be within the range of about 10 seconds to about 30 seconds. It is more typical for the heating period in a fluidized bed oven to be within the range of about 15 seconds to about 20 seconds. It is also possible to heat the wire for the patenting procedure in a convection oven. However, in cases where convection heating is used, longer heating periods are required. For instance, it is typically necessary to heat the wire by convection for a period of at least about 40 seconds. It is preferable for the wire to be heated by convection for a period within the range of about 45 seconds to about 2 minutes.

The exact duration of the heating period is not critical. However, it is important for the temperature to be maintained for a period which is sufficient for the alloy to be austenitized. In commercial operations, temperatures within the range of 900° C. to about 1150° C. are utilized to austenitize the alloy in the wire. More preferably, the temperature used to austenitize the alloy in the wire will be within the range of about 1000° C. to about 1100° C.

In the patenting procedure after the austenite has formed, it is important to rapidly cool the steel wire to a temperature which is within the range of about 520° C. to about 620° C. within a period of less than about 4 seconds. It is desirable for this cooling to take place within a period of 3 seconds or less. This rapid cooling can be accomplished by immersing the wire in molten lead which is maintained at a temperature of 580° C. Numerous other techniques for rapidly cooling the wire can also be employed.

After the wire has been quenched to a temperature within the range of about 520° C. to about 620° C., it is necessary to maintain the wire at a temperature within that range for a period of time which is sufficient for the microstructure of the steel in the steel wire to transform to an essentially face-centered cubic microstructure from the body-centered cubic microstructure of the austenite. As has been indicated, for practical reasons, it is very important for this transformation to occur within about 15 seconds with it being highly preferable for the transformation to occur within a period of 10 seconds or less.

The patenting procedure is considered to be completed after the transformation to an essentially body-centered cubic microstructure has been attained. After the completion of the first patenting step, the patented wire is further drawn using a cold drawing procedure. In this drawing step, the diameter of the wire is reduced by about 40 to about 90 percent. It is preferred for the diameter of the wire to be reduced by 80 percent to 90 percent in the drawing procedure. After this drawing procedure has been completed, the drawn wire typically has a diameter of from about 1 mm to about 2 mm. For example, a wire having an original diameter of 3.2 mm could be drawn to a diameter of about 1.4 mm.

The cold-drawn wire is then patented in a second patenting step. This second patenting procedure is done utilizing essentially the same techniques as are employed in the first patenting step. However, due to the reduced diameter of the wire, less heating time is required to austenitize the alloy in the wire. For instance, if electrical resistance heating is utilized, the heating step in the second patenting procedure can be accomplished in as little as about 1 second. However, it may be necessary to expose the wire to electrical resistance heating for a period of 2 seconds or longer for the alloy to be austenitized as required. In cases where a fluidized bed oven is employed for heating, a heating time of 4 to 12 seconds is typical. In situations where convection heating is used, a heating time within the range of about 15 seconds to about 60 seconds is typical.

After the wire has completed the second patenting procedure, it is, again, cold-drawn. In this cold drawing procedure, the diameter of the wire is reduced by about 80 percent to about 99 percent to produce the steel filaments of this invention. It is more typical for the diameter of the wire to be reduced by about 90 percent to about 99 percent. Thus, the filaments of this invention typically have a diameter which is within the range of about 0.05 mm to about 0.45 mm. Filaments having a diameters which are within the range of about 0.10 mm to about 0.30 mm are typical.

In many cases, it will be desirable to twist two or more filaments into cable for utilization as reinforcements for rubber products. For instance, it is typical to twist two such filaments into cable for utilization in passenger tires. It is, of course, also possible to twist a larger number of such filaments into cable for utilization in other applications. For instance, it is typical to twist about 50 filaments into cables which are ultimately employed in earthmover tires. In many cases, it is desirable to coat the steel alloy with a brass coating. Such a procedure for coating steel reinforcing elements with a ternary brass alloy is described in U.S. Pat. No. 4,446,198, which is incorporated herein by reference.

While certain representative embodiments and details have been shown for the purpose of illustrating this invention, it will be apparent to those skilled in this art that various changes and modifications can be made herein without departing from the scope of this invention.

What is claimed is:

1. A steel alloy which is particularly suitable for use in manufacturing reinforcing wire for rubber products consists of (a) iron, (b) about 1.05 to about 1.7 weight percent carbon, (c) about 0.2 to about 0.8 weight percent manganese, (d) about 0.1 to about 0.8 weight percent silicon, (e) about 0.1 to about 0.7 weight percent chromium and (f) about 0.02 to about 0.3 weight percent copper (g) 0.0 to about 0.5 weight percent nickel, (h) 0.0 to about 0.5 weight percent molybdenum and (i) 0.0 to about 0.5 weight percent vanadium; with the proviso that the carbon equivalent of the steel alloy is within the range of 1.15 to 1.8 weight percent, wherein the carbon equivalent is determined by the equation:

$$CE = C + \frac{Mn + Si}{6} + \frac{Ni + Cu}{15} + \frac{Cr + Mo + V}{5}$$

wherein CE represents the carbon equivalent, wherein C represents the weight percentage of carbon in the steel alloy, wherein Mn represents the weight percentage of manganese in the steel alloy, wherein Si represents the weight percentage of silicon in the steel alloy, wherein Ni represents the weight percentage of nickel in the steel alloy, wherein Cu represents the weight percentage of copper in the steel alloy, wherein Cr represents the weight percentage of chromium in the steel alloy, wherein Mo represents the weight percentage of molybdenum in the steel alloy and wherein V represents the weight percentage of vanadium in the steel alloy.

2. A steel alloy which is particularly suitable for use in manufacturing reinforcing wire for rubber products consists of (a) iron, (b) about 1.1 to about 1.5 weight percent carbon, (c) about 0.3 to about 0.7 weight percent manganese, (d) about 0.1 to about 0.6 weight percent silicon, (e) about 0.1 to about 0.6 weight percent chromium, (f) about 0.05 to about 0.2 weight percent copper (g) 0.0 to about 0.5 weight percent nickel, (h) 0.0 to about 0.5 weight percent molybdenum and (i) 0.0 to about 0.5 weight percent vanadium; with the proviso that the carbon equivalent of the steel alloy is within the range of 1.15 to 1.8 weight percent, wherein the carbon equivalent is determined by the equation:

$$CE = C + \frac{Mn + Si}{6} + \frac{Ni + Cu}{15} + \frac{Cr + Mo + V}{5}$$

wherein CE represents the carbon equivalent, wherein C represents the weight percentage of carbon in the steel alloy, wherein Mn represents the weight percentage of manganese in the steel alloy, wherein Si represents the weight percentage of silicon in the steel alloy, wherein Ni represents the weight percentage of nickel in the steel alloy, wherein Cu represents the weight percentage of copper in the steel alloy, wherein Cr represents the weight percentage of chromium in the steel alloy, wherein Mo represents the weight percentage of molybdenum in the steel alloy and wherein V represents the weight percentage of vanadium in the steel alloy.

3. A steel alloy which is particularly suitable for use in manufacturing reinforcing wire for rubber products consists of (a) iron, (b) about 1.1 to about 1.5 weight percent carbon, (c) about 0.3 to about 0.7 weight percent manganese, (d) about 0.1 to about 0.6 weight percent silicon, (e) about 0.1 to about 0.6 weight percent chromium, (f) about 0.10 to about 0.15 weight percent copper (g) 0.0 to about 0.5 weight percent nickel, (h) 0.0 to about 0.5 weight percent molybdenum and (i) 0.0 to about 0.5 weight percent vanadium; with the proviso that the carbon equivalent of the steel alloy is within the range of 1.15 to 1.8 weight percent, wherein the carbon equivalent is determined by the equation:

$$CE = C + \frac{Mn + Si}{6} + \frac{Ni + Cu}{15} + \frac{Cr + Mo + V}{5}$$

wherein CE represents the carbon equivalent, wherein C represents the weight percentage of carbon in the steel alloy, wherein Mn represents the weight percentage of manganese in the steel alloy, wherein Si represents the weight percentage of silicon in the steel alloy, wherein Ni represents the weight percentage of nickel in the steel alloy, wherein Cu represents the weight percentage of copper in the steel alloy, wherein Cr represents the weight percentage of chromium in the steel alloy, wherein Mo represents the weight percentage of molybdenum in the steel alloy and wherein V represents the weight percentage of vanadium in the steel alloy.

4. A steel alloy which is particularly suitable for use in manufacturing reinforcing wire for rubber products consists of (a) iron, (b) about 1.2 to about 1.4 weight percent carbon, (c) about 0.4 to about 0.6 weight percent manganese, (d) about 0.2 to about 0.4 weight percent silicon, (e) about 0.2 to about 0.5 weight percent chromium, (f) 0.10 to about 0.15 weight percent copper (g) 0.0 to about 0.5 weight percent nickel, (h) 0.0 to about 0.5 weight percent molybdenum and (i) 0.0 to about 0.5 weight percent vanadium; with the proviso that the carbon equivalent of the steel alloy is within the range of 1.15 to 1.8 weight percent, wherein the carbon equivalent is determined by the equation:

$$CE = C + \frac{Mn + Si}{6} + \frac{Ni + Cu}{15} + \frac{Cr + Mo + V}{5}$$

wherein CE represents the carbon equivalent, wherein C represents the weight percentage of carbon in the steel alloy, wherein Mn represents the weight percentage of manganese in the steel alloy, wherein Si represents the weight percentage of silicon in the steel alloy, wherein Ni represents the weight percentage of nickel in the steel alloy, wherein Cu represents the weight percentage of copper in the steel alloy, wherein Cr represents the weight percentage of chromium in the steel alloy, wherein Mo represents the weight percentage of molybdenum in the steel alloy and wherein V represents the weight percentage of vanadium in the steel alloy.

5. A steel alloy as specified in claim 1 wherein said steel alloy has a carbon equivalent percentage which is within the range of about 1.2 to about 1.6.

6. A steel alloy as specified in claim 1 wherein said steel alloy has a carbon equivalent percentage which is within the range of about 1.3 to about 1.5.

7. A steel alloy as specified in claim 2 wherein said steel alloy has a carbon equivalent percentage which is within the range of about 1.2 to about 1.6.

8. A steel alloy as specified in claim 2 wherein said steel alloy has a carbon equivalent percentage which is within the range of about 1.3 to about 1.5.

9. A steel alloy as specified in claim 3 wherein said steel alloy has a carbon equivalent percentage which is within the range of about 1.2 to about 1.6.

10. A steel alloy as specified in claim 3 wherein said steel alloy has a carbon equivalent percentage which is within the range of about 1.3 to about 1.5.

11. A steel alloy as specified in claim 4 wherein said steel alloy has a carbon equivalent percentage which is within the range of about 1.2 to about 1.6.

12. A steel alloy as specified in claim 4 wherein said steel alloy has a carbon equivalent percentage which is within the range of about 1.3 to about 1.5.

13. A steel alloy as specified in claim 1 wherein said steel alloy is void of nickel, molybdenum and vanadium.

14. A steel alloy as specified in claim 2 wherein said steel alloy is void of nickel, molybdenum and vanadium.

15. A steel alloy as specified in claim 3 wherein said steel alloy is void of nickel, molybdenum and vanadium.

16. A steel alloy as specified in claim 4 wherein said steel alloy is void of nickel, molybdenum and vanadium.

* * * * *